US010267182B2

(12) United States Patent
Cheng et al.

(10) Patent No.: US 10,267,182 B2
(45) Date of Patent: Apr. 23, 2019

(54) METHODS AND APPARATUS TO OPTIMIZE STEAM TURBINE RAMP RATES

(71) Applicant: Emerson Process Management Power and Water Solutions, Inc., Pittsburgh, PA (US)

(72) Inventors: Xu Cheng, Pittsburgh, PA (US); Frederick Charles Huff, Pittsburgh, PA (US); Melanie Jean Novacek, Jeannette, PA (US); Ranjit R. Rao, Gibsonia, PA (US)

(73) Assignee: Emerson Process Management Power & Water Solutions, Inc., Pittsburgh, PA (US)

( * ) Notice: Subject to any disclaimer, the term of this patent is extended or adjusted under 35 U.S.C. 154(b) by 885 days.

(21) Appl. No.: 14/789,021

(22) Filed: Jul. 1, 2015

(65) Prior Publication Data

US 2017/0002692 A1 Jan. 5, 2017

(51) Int. Cl.
*F01K 13/02* (2006.01)

(52) U.S. Cl.
CPC ..... *F01K 13/02* (2013.01)

(58) Field of Classification Search
CPC ..... F01K 13/02
See application file for complete search history.

(56) References Cited

U.S. PATENT DOCUMENTS

| | | | |
|---|---|---|---|
| 4,215,552 | A | 8/1980 | Riollet et al. |
| 4,558,227 | A | 12/1985 | Yanada et al. |
| 7,980,053 | B2 | 7/2011 | Yakushi et al. |
| 8,560,283 | B2 | 10/2013 | Cheng et al. |
| 2009/0292436 | A1 | 11/2009 | D'Amato et al. |
| 2010/0305768 | A1 | 12/2010 | Holt et al. |
| 2012/0131917 | A1 | 5/2012 | Piccirillo et al. |
| 2014/0260288 | A1 | 9/2014 | D'Amato et al. |
| 2017/0022846 | A1 | 1/2017 | Rao et al. |

FOREIGN PATENT DOCUMENTS

| | | |
|---|---|---|
| EP | 1707757 | 4/2006 |
| EP | 2871333 | 5/2015 |
| JP | S5444105 A | 4/1979 |

(Continued)

OTHER PUBLICATIONS

Intellectual Property Office of Great Britain, "Search Report," issued in connection with Patent Application No. GB1610542.1, dated Dec. 13, 2016, 6 pages.

(Continued)

*Primary Examiner* — Richard A Edgar
*Assistant Examiner* — Michael L Sehn
(74) *Attorney, Agent, or Firm* — Hanley, Flight & Zimmerman, LLC

(57) ABSTRACT

Methods and apparatus to optimize turbine ramp rates are disclosed herein. An example method includes predicting a setpoint for a turbine rotor over a prediction horizon. The example method includes predicting a surface temperature profile of the turbine rotor for the prediction horizon based on the predicted setpoint via an empirical data model. The example method also includes predicting a first stress profile for the turbine rotor based on the surface temperature profile. The example method includes performing a comparison of the first stress value to a second stress value and dynamically adjusting the setpoint based on the comparison.

20 Claims, 5 Drawing Sheets

(56) References Cited

FOREIGN PATENT DOCUMENTS

| | | | |
|---|---|---|---|
| JP | S9226211 | A | 12/1984 |
| JP | S26178704 | A | 8/1987 |
| JP | 09-317404 | | 12/1997 |

OTHER PUBLICATIONS

Intellectual Property Office of Great Britain, "Search Report," issued in connection with Patent Application No. GB1612494.3, dated Feb. 8, 2017, 4 pages.
Ehrsam et al., "Steam Turbine Start-up Optimization Tool based on ABAQUS and Python Scripting", 2009 SIMULIA Customer Conference (May 2009), 8 pages.
Optimize IT Brochure, "Optimize It Predict & Control (P&C)", Italy ABB Via Hermada, 616154 Genova, Italy, copyright 2006, 4 pages.
Nakai et al., "Turbine Start-up Algorithm Based on Prediction of Rotor Thermal Stress," Proceedings of the 34th SICE Annual Conference (Jul. 1995), pp. 1561-1564, 4 pages.
Matsumura et al., "Steam Turbine Start Up Method Based on Predictive Monitoring and Control of Thermal Stress," IEE Transactions on Power Apparatus and Systems, vol. PAS-104, No. 4 (Apr. 1985), pp. 821-828, 8 pages.
Emerson Process Management, "Turbine Stress Evaluator Data Sheet," (2010), 4 pages.
"OG&E Seminole Unit 2, Rotor Stress Analysis Documentation, Rev. 1," (Feb. 2010), 8 pages.
Emerson Process Management, "Hot Reheat Turbine Bypass," (Jun. 15, 2003), 2 pages.
"Heat Recovery Steam Generator," available at https://www.myodesie.com/wiki/index/returnEntry/id/2994 (last accessed Jul. 20, 2015), 13 pages.
United States Patent and Trademark Office, "Restriction Requirement," issued in connection with U.S. Appl. No. 15/210,439, dated Dec. 17, 2018, 7 pages.

METHODS AND APPARATUS TO OPTIMIZE STEAM TURBINE RAMP RATES

FIELD OF THE DISCLOSURE

This disclosure relates generally to steam turbines and, more particularly, to methods and apparatus to optimize steam turbine ramp rates.

BACKGROUND

During periods such as start-up and shutdown, a steam turbine is exposed to changes in temperature that affect a temperature of the metal components of the steam turbine, such as the rotor. As a result of transitory thermal situations such as start-up, the rotor experiences thermal stress due to differences in metal temperature throughout the rotor as the steam turbine transitions from a non-operating state to an operating state and the rotor is heated. A start-up time of a steam turbine can affect the thermal stress experienced by the rotor.

SUMMARY

Figure 1:
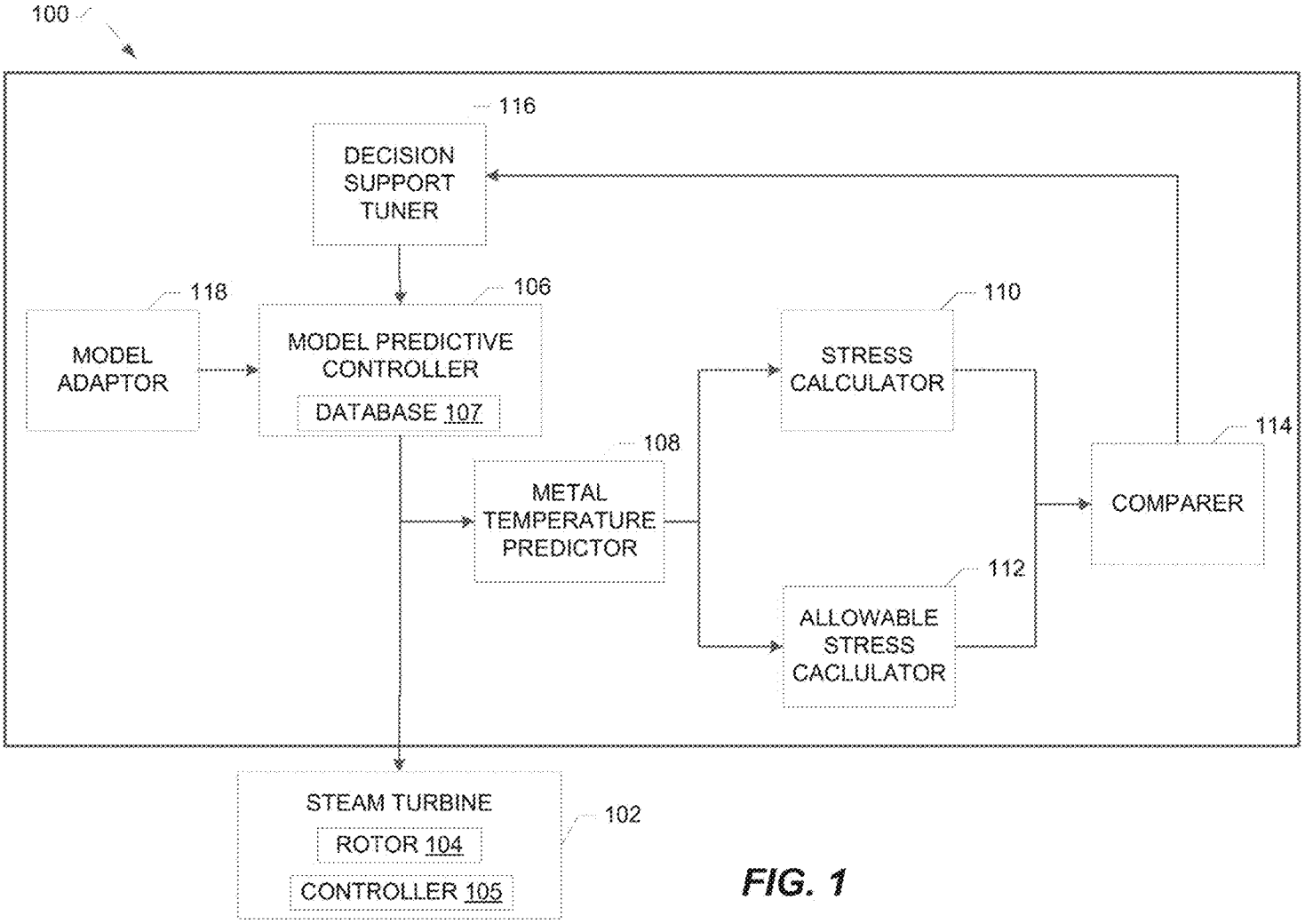
FIG. 1 is a block diagram of an example control system for determining a speed setpoint or a load setpoint of a steam turbine.

An example method disclosed herein includes predicting a setpoint for a turbine rotor over a prediction horizon. The example method includes predicting a surface temperature profile of the turbine rotor for the prediction horizon based on the predicted setpoint via an empirical data model. The example method also includes predicting a first stress profile for the turbine rotor based on the surface temperature profile, performing a comparison of the first stress profile to a second stress profile, and dynamically adjusting the setpoint based on the comparison.

An example system disclosed herein includes a controller to predict a first setpoint of a turbine based on a prediction model and a controller tuning parameter to ramp the turbine from a first operating state to a second operating state at a first rate. The example system includes a temperature predictor to predict a surface temperature of one or more components of the turbine based on the first setpoint and known temperature data. The example system includes a first stress calculator to determine a first stress on the turbine based on the predicted surface temperature and a comparer to compare the first stress to a second stress. The example system also includes an adjuster to adjust the controller tuning parameter based on the comparison. In the example system, if the first stress exceeds the second stress, the controller is to predict a second setpoint based on the prediction model and the adjusted controller tuning parameter to ramp the turbine from the first operating state to the second operating state at a second rate. The second rate is a reduced rate relative to the first rate.

Also disclosed herein is an example method for transitioning a turbine from a non-operating state to an operating state. The example method includes determining a setpoint at which the turbine is to transition from the non-operating state to the operating state. The example method includes calculating a surface temperature of a rotor of the turbine based on the setpoint and empirical temperature data. The example method includes calculating a first stress on the rotor based on the surface temperature and comparing the first stress to an allowable stress limit for the turbine. If the first stress exceeds the allowable stress limit, the example method includes at least one of stopping or slowing a ramping of the turbine from the non-operating state to the operating state or reducing the setpoint. If the first stress is below the allowable stress limit by a threshold amount, the example method includes increasing the setpoint of the turbine.

DETAILED DESCRIPTION

Transitioning a steam turbine from a non-operating state to an operating state includes warming up components of the turbine such as the turbine rotor. The rotor can be transitioned to an operating state by gradually increasing a speed at which the blades of the rotor rotate. During start-up, steam is introduced into the turbine via one or more valves. The steam acts on the rotor blades to cause the blades to rotate. The steam causes the turbine to start up gradually by rotating, for example, the blades of the rotor from a speed of zero revolutions per minute (RPMs) to a speed less than a predetermined operating speed (e.g., less than 3,600 RPMs). The speed at which the blades rotate increases over the start-up period until the predetermined operating speed is reached (e.g., 3,600 RPMs) and the turbine is fully operational. When the steam turbine is fully operational, the turbine can be used to drive a generator associated with the turbine to generate electricity, which places a load on a power grid associated with the turbine.

As the steam turbine transitions from the non-operating state to the operating state during start-up, the rotor is exposed to thermal stress as the temperature and flow of the steam admitted to the turbine and the rotational energy imparted by the steam on the rotor blades affect a surface temperature of the components of the rotor. As the rotor is exposed to steam and the blades rotate, a temperature of the metal surfaces of the rotor blades may increase at a different rate than a temperature of, for example, an interior metal component of the rotor. The non-uniform changes in surface temperature throughout the rotor are based on, for example, a size of the rotor and a thickness of the rotor components. The different surface temperatures across the rotor during start-up result in the thermal stress experienced by the rotor. When the temperature of the rotor is substantially uniform throughout the rotor, the thermal stress experienced by the rotor is substantially decreased or eliminated.

Exposure to thermal stress as result of frequent and/or quick start-ups can reduce the useful life of the rotor. For example, as a result of thermal stress, one or more components of the rotor may be subject to cracking due to metal fatigue that propagates throughout the rotor. Factors such as a magnitude of the stress, a rate of the temperature change, and material properties of the rotor affect the useful life of the rotor.

Generally, to avoid exposing the rotor to excessive thermal stress, the turbine start-up time is increased (e.g., the turbine is started more slowly than may be necessary) to enable heating of the rotor throughout while minimizing thermal stress. In some examples, start-up times are based on loading charts supplied by turbine manufactures that provide a permissible rate of temperature change. However, such charts are often based on assumptions such as a uniform rotor temperature and/or a constant ramp rate. Further, increasing the turbine start-up time in an effort to achieve a substantially uniform temperature of the rotor components is inefficient with respect to time and cost for a power generation plant where the turbine is in operation.

Disclosed herein are example methods and systems to determine a setpoint (e.g., a ramp setpoint) for a turbine, or a value that controls a ramp rate at which the turbine rotor reaches (1) an operational speed (e.g., RPM) before a breaker associated with the turbine's generator closes, i.e., a speed setpoint, and/or (2) an amount of power (e.g., megawatts (MW)) to be generated by the turbine after the breaker associated with the generator closes, i.e., a load setpoint. The setpoint (e.g., the speed setpoint or the load setpoint, hereinafter generally referred to as a "setpoint") is determined using model predictive control (MPC) logic that predicts the setpoint over a look-ahead period or a prediction horizon. The examples disclosed herein determine a setpoint that minimizes the thermal stress experienced by the rotor by predicting a stress that the rotor will experience at a given setpoint and comparing the predicted stress to an allowable stress. The examples disclosed herein dynamically adjust the setpoint of the turbine based on the comparison. As the setpoint values determined via the disclosed example methods and systems dynamically change over time, the setpoint values reflect of a rate of change or a ramp rate (e.g., RPM/sec or MW/min) of the turbine. Further, the disclosed examples use the comparison between the predicted stress and the allowable stress as feedback to automatically tune or adjust the MPC logic that is used to determine the setpoint.

Turning to the figures, FIG. 1 is a block diagram of an example control system 100 for determining a setpoint that provides for start-up and/or operation of a steam turbine 102 within an allowable thermal stress range for a rotor 104 of the turbine 102. The turbine 102 can be, for example, a combined cyclic unit, a coal unit, or an oil-fired unit. The turbine 102 includes a turbine controller 105 to execute control logic in response to the setpoint determined by the example control system 100. In particular, the example control system 100 includes a model predictive controller 106 (hereinafter "the controller 106") that predicts a speed setpoint or a load setpoint based on one or more inputs and adjusts the predicted setpoint in response to feedback from one or more other components of the example control system 100, as will be disclosed below. The turbine controller 105 implements logic to start-up or operate the steam turbine 102 based on the setpoint received from the example control system 100.

To predict the setpoint, the controller 106 receives a target setpoint $y_{set}$ from, for example, a user input. In operation, the target setpoint $y_{set}$ can be a speed setpoint associated with a speed of the rotor. The target speed setpoint $y_{set}$ can be based on, for example, a predetermined or a desired time for ramping or transitioning the turbine 102 to a fully operational state. Alternatively, the target setpoint $y_{set}$ can be a load setpoint associated with power generation. The user input with respect to the load can be based on data from a generator associated with the turbine 102.

To predict the setpoint, the controller 106 employs MPC logic to generate a control signal or input that is provided to the turbine 102. The control input represents a speed demand or a load demand on the turbine 102. A predicted process output of the MPC logic represents a speed or a load response of the turbine based on the control input. The MPC logic provides for optimization of future behavior of a process over a finite prediction time period or a prediction horizon. In particular, the MPC logic computes a control signal that minimizes an objective function such that a predicted output variable follows or substantially follows a reference trajectory. In the example control system 100, the controller 106 uses MPC logic to optimize the behavior of the turbine 102 such that a predicted process output or predicted setpoint output trajectory $y^p$ (e.g., speed or load) approaches the target setpoint $y_{set}$. Further, the controller 106 of the example system 100 implements the MPC logic with respect to a current time k and for a forward simulation phase to predict the predicted setpoint $y^p$ over a prediction horizon.

In particular, a current or real-time state of the turbine is sampled at a sampling time k to obtain initial conditions for one or more state variables associated with the turbine 102. In general, a multi-input and multi-output plant can be described by the following state space equations:

$$x(k+1)=Ax(k)+Bu(k) \quad \text{(Eq. 1a); and}$$

$$y(k)=Cx(k) \quad \text{(Eq. 1b);}$$

where x is a state variable vector; u is a control input vector; y is a process output vector; and A, B, and C are constants.

An MPC optimization at time k can be performed based on the following conventions and expressions. A measured state variable of the turbine 102 at time k can be described by the expression $x(k|k)=x(k)$ and an estimated state variable at time k can be described as $\hat{x}(k|k)$. Also, a prediction horizon for the optimization can be represented by the variable $H_p$ and a control horizon can be represented by the variable $H_c$. One or more predicted state variables at time k+i based on the measured state variable x(k) (or the estimated state variable $\hat{x}(k|k)$) can be described as $x^p(k+$, where $(i=1, \ldots, H_p)$. Also, one or more predicted control input variables at time k+i can be described as $u^p(k+i-1|k)$, where $(i=1, \ldots, H_p)$. Based on the foregoing conventions and expressions, the MPC logic can be implemented by the controller 106 as follows.

First, initial or estimated conditions for one or more state variables x at time k are obtained. The estimated state variable $\hat{x}(k|k)$ at time k can be obtained using the following state estimation equation:

$$\hat{x}(k|k)=(A-K_eCA)\cdot\hat{x}(k-1|k-1)+(B-K_eCB)\cdot u(k-1)+K_ey(k) \quad \text{(Eq. 2),}$$

where $K_e$ is a predefined state estimator gain and y(k) is a real-time measurement of the output variable y(k).

To optimize the ramp rate behavior of the turbine 102 at the current sampling time k, a predicted state variable $x^p(k|k)$ is defined such that $x^p(k|k)=\hat{x}(k|k)$, where $\hat{x}(k|k)$ is the estimated state variable found using Equation 2 above. The following optimization is solved at the sample time k to minimize a difference between the predicted process output $y^p$ and the target setpoint $y_{set}$ and to determine a predicted control input or demand signal $u^p$ that represents the turbine speed or load demands to be placed on the turbine 102:

$$\min_{u^p(k|k),\ \ldots\ ,u^p(k+Hp-1|k)} \sum_{i=1}^{H_p} \{\|y^p(k+i+1\mid k) - y_{set} + y_d^p(k+i+1\mid k) + err(k)\|_Q^2 + \|\Delta u^p(k+i\mid k)\|_R^2\}, \quad \text{(Eq. 3)}$$

where $err(k)=y(k)-y^p(k|k)$; (Output Error)

$x^p(k+i+1|k)=Ax^p(k+i|k)+Bu^p(k+i|k)$ (State equation);

$y^p(k+i|k)=Cx^p(k|k)$ (Output equation);

$u^p(k+H_c+j|k)=u^p(k+H_c|k)$, $(j=1, 2, \ldots, H_p-H_c)$ and $|u^p(k+i|k)|\leq U_{max}$ (Control input constraints);

$|y^p(k+i|k)|\leq Y_{max}$ (Process output constraints); and $(i=0, 1, \ldots, H_p)$.

The output equation is used to calculate the predicted process output $y^p$ or the load or speed response of the turbine 102. To minimize the difference between the predicted process output $y^p$ and the target setpoint $y_{set}$. Equation 3 accounts for any error between the process output y(k) (e.g., the actual process output at time k) and the predicted output $y^p(k|k)$ at time k, as represented by output error equation err(k), above. Further, constraints on the predicted process output $y^p$ are accounted for in the optimization process of Equation 3. For example, the process output constraints $Y_{max}$ define an expected boundary or range for the predicted process output $y^p$. The process output constraints $Y_{max}$ can be considered to be soft constraints in that the process output constraints $Y_{max}$ represents performance of the turbine 102 in terms of process deviations from the expected range for the predicted process output $y^p$. In some examples, the predicted process output $y^p$ can deviate from (e.g., exceed) the process output constraints $Y_{max}$ if the optimization of Equation 3 encounters a feasibility problem with respect to minimizing the difference between the predicted process output $y^p$ and the target setpoint $y_{set}$. In such examples, the process output constraints $Y_{max}$ can be relaxed in an effort to increase a likelihood of finding a feasible solution for optimizing the setpoint.

The predicted process control input signal $u^p$ is sent to the turbine controller 105 and represents a speed demand or load demand to which the turbine 102 responds (e.g., by generating or substantially generating the predicted process output $y^p$). Upon receipt of the process control input signal $u^p$ by the turbine controller 105, the process control input signal $u^p$ is converted to one or more device control signals, such as a fuel input signal or a turbine governing valve position signal (e.g., for controlling a flow rate of the steam) based on the speed or load demands associated with the process input signal $u^p$. The optimization of Equation 3 constrains the predicted process control input signal $u^p$ in view of physical or operational limitations of the turbine 102. For example, the control input constraints $U_{max}$ represent physical or operational limitations (e.g., speed) of one or more components of the turbine 102, such as a turbine actuator. The control input constraints $U_{max}$ limit the predicted process control input signal $u^p$ in view of the physical or operational limitations of the turbine components with respect to moving the turbine 102 from a non-operating state to an operating state. In contrast to the process output constraints $Y_{max}$, the control input constraints $U_{max}$ are hard constraints as they represent the physical or operational limitations of one or more components of the turbine 102 that cannot be deviated from without damage to the turbine 102.

In Equation 3, the parameters Q and R are weighting factors with respect to the predicted process output $y^p$ and the predicted control input signal $u^p$. For example, if the Q parameter has a large value relative to the R parameter, the predicted control input signal $u^p$ results in more aggressive load or speed demands placed on the turbine 102 by the controller 106 (e.g., resulting in a faster ramp rate) as compared to when the R parameter has a larger value relative to the Q parameter (e.g., a slower ramp rate but, in some examples, a more stable response by the turbine 102). In some examples, the values of the parameters Q and R are set based on predetermined or empirical values. The values of the parameters Q and R can be adjusted in view of one or more of, for example, the target setpoint $y_{set}$, the predicted process output $y^p$, and/or the predicted control input signal $u^p$.

After completion of the optimization of Equation 3 at time k, the predicted control input variable $u^p$ is set as the control input signal u(k) at time k such that $u(k)=u^p(k|k)$. In setting the control input signal u(k) as the predicted control input variable $u^p$, a control signal representative of the predicted control input $u^p$ at time k is sent to the turbine controller 105. Thus, in the above disclosed MPC logic, the predicted control input $u^p$ is the actual control input signal sent to the turbine controller 105.

In known implementations of MPC logic, identifying the initial conditions for the state variables and performing the optimization of Equation 3 are repeated for a subsequent real-time (e.g., actual) sampling time k+1. A new predicted control input signal $u^p(k+1)$ is determined and the control input signal u(k+1) is set as the predicted control input signal $u^p(k+1)$. Thus, the predicted control input signal $u^p$ at each sampling time k, k+1, k+n, etc. serves as the control input signal sent to the turbine controller 105.

In the disclosed examples, the controller 106 applies the MPC logic as disclosed above to optimize the predicted process output $y^p$ in view of the target setpoint $y_{set}$. Further, the controller 106 introduces a forward simulation phase to predict the setpoint over an extended horizon period, thereby increasing the predictive capabilities of the controller 106. Implementation of the MPC logic as disclosed above generally uses a short control horizon $H_c$, which minimizes a number of optimization variables that are solved in real-time and limits the prediction range of the MPC logic to the horizon control period (e.g., $u^p(k)$, $u^p(k+1)$ . . . $u^p(k+H_c)$. By including a forward simulation phase, the disclosed examples optimize the determination of the setpoint by enhancing the prediction component of the MPC logic.

Figure 2:
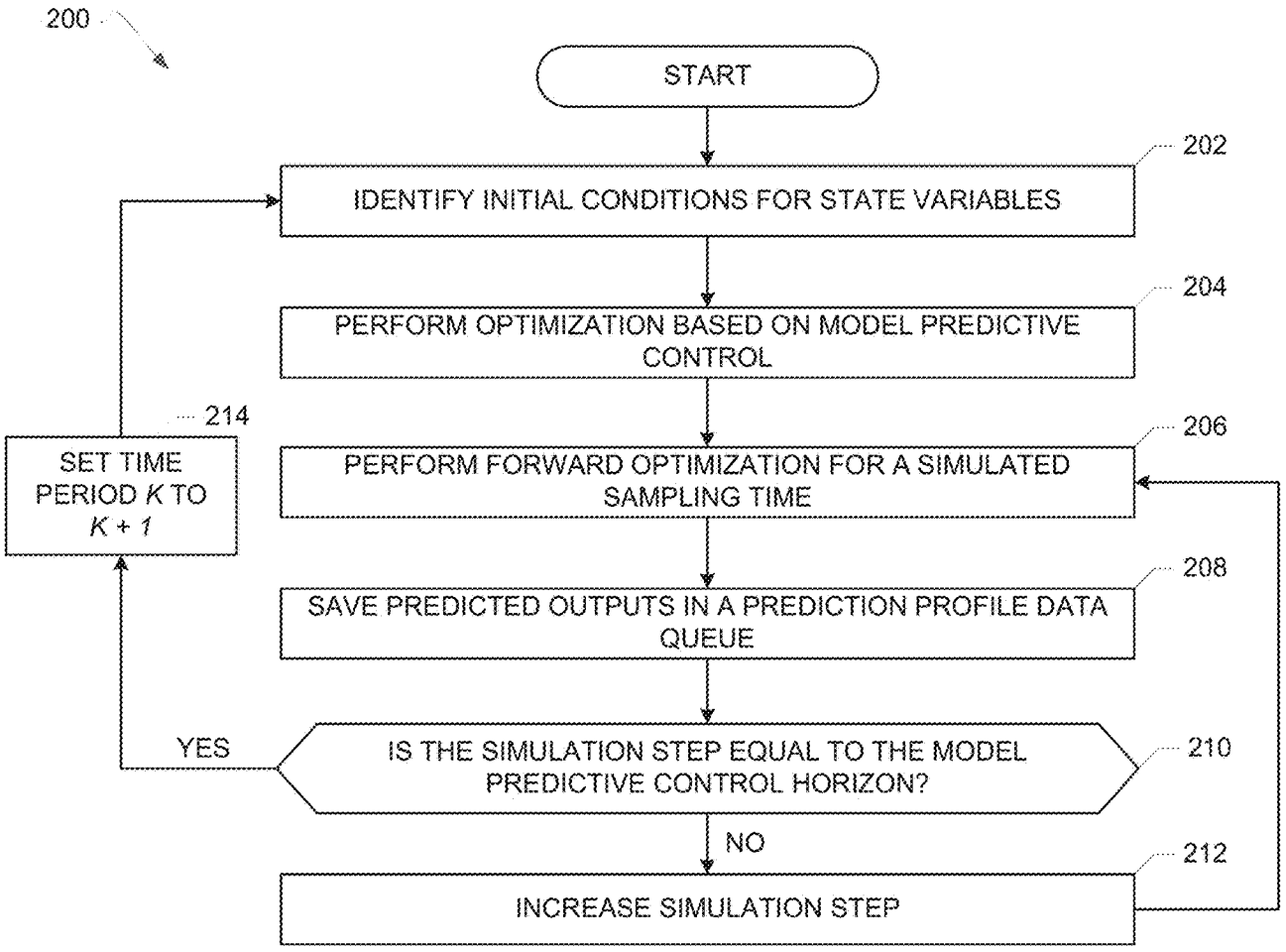
FIG. 2 is a flow diagram of an example method that may be performed by a controller of the example control system 100 to predict the speed setpoint or the load setpoint.

FIG. 2 is a flow diagram of an example method 200 that can be implemented by the controller 106 of FIG. 1 to predict a setpoint using MPC logic and including a forward simulation model. The example method 200 includes identifying initial conditions for state variables as disclosed above in connection with Equations 1a, 1b, and 2 (block 202). The example method 200 also includes performing an optimization as disclosed above in connection with in Equation 3 (block 204).

As described above, known implementations of MPC logic provide for an iterative optimization in that after the optimization is generated at an actual time k, the state variables are sampled at time k+1 and the optimization is repeated at time k+1 to generate a new control input signal u(k+1). Rather than repeating the optimization for the sampling time k+1 to generate a new predicted control input signal $u^p(k+1)$ that serves as the actual control input signal at time k+1, the example method 200 includes performing an optimization for a simulated sampling time period according to a simulation model (block 206). As will be disclosed below, the optimization is performed for simulated sampling steps (e.g., a simulated time k+1). The predicted or future process output $y^p$ from the forward simulation model is used by the example system 100 to evaluate the predicted setpoint in view of an allowable stress for the turbine 102.

For example, a prediction horizon $H_p$ over which the control input signal $u^p$ is predicted can include one or more time periods, for example, four discrete time periods (a first time period, a second time period, a third time period, and a fourth time period). In such examples, a simulated sampling time can be one time period. In the example simulation model, a forward simulation is performed over the prediction horizon $H_p$ from the first time period to the fourth time period and, thus, includes four simulation steps. The forward simulation is moved forward to the second time period, such that when the simulation is run from the second time period to the fourth time period, the number of simulation steps equals three. Thus, each time the simulation step is advanced by the sampling time of one time period, the simulation steps increment or move forward by one time period. The prediction horizon remains four time periods and eventually the simulation steps are performed over the length of the prediction horizon $H_p$ (e.g., four time periods).

Performing the optimization for the simulated sampling time according to the example simulation model disclosed herein includes setting the predicted state variable $x^p(k|k)$ at a simulated sampling time k as $x^p(k|k)=x^p(k+1|k)$, where time k+1 represents a forward simulation phase. An optimization is performed at the simulated sampling time k such that:

$$\min_{u^p(k|k),\ \ldots\ ,u^p(k+Hp-1|k)} \sum_{i=1}^{H_p} \{\|y^p(k+i+1\mid k) - y_{set} + y_d^p(k+i+1\mid k) + err(k)\|_Q^2 + \|\Delta u^p(k+i\mid k)\|_R^2\}, \quad \text{(Eq. 4)}$$

where $err(k)=y(k)-y^p(k|k)$; (Output Error)

$x^p(k+i+1|k)=Ax^p(k+i|k)+Bu^p(k+i|k)$ (State equation);

$y^p(k+i|k)=Cx^p(k|k)$ (Output equation);

$u^p(k+H_c+j|k)=u^p(k+H_c|k)$, $(j=1, 2, \ldots, H_p-H_c)$ and $|u^p(k+i|k)|\leq U_{max}$ (Control input constraints);

$|y^p(k+i|k)|\leq Y_{max}$ (Process output constraints); and $(i=0, 1, \ldots, H_p)$.

Thus, the difference between the optimization performed using Equation 3 disclosed above and the optimization performed using Equation 4 is based on the definition of the predicted state variable $x^p(k|k)$. In Equation 3, the predicted state variable is set as the estimated state variable $\hat{x}(k|k)$ at the current time k. In Equation 4 of the example simulation model, the predicted state variable $\hat{x}(k|k)$ is set as the simulated state variable for a forward simulation period k+1, or $x^p(k+1|k)$.

The example method 200 continues with saving the predicted process control input $u^p(k)$ and the resulting predicted process output $y^p(k)$ from the optimization of Equation 4 at the simulated time step k in a prediction profile data queue or database, such as the database 107 of the example controller 106 of FIG. 1 (block 208). The prediction profile database 107 is stored in a memory associated with the example system 100 (e.g., a memory 513 of an example processor platform 500 of FIG. 5, below). After each simulation step, the predicted process input control signal $u^p$ is used in the repeated optimizations at each simulation step rather than being used as the actual input control signal that is sent to the turbine controller 105. Thus, during the forward simulation phase, the repeated optimizations build a load/speed profile including predicted process control input $u^p(k)$ and the resulting predicted process output $y^p(k)$.

In particular, the predicted process output $y^p(k)$ for each simulated step saved in the prediction profile database 107 is indicative of a predicted load or speed response of the turbine 102 at a future time. The predicted process output $y^p(k)$ or setpoint is used by the other components of the example system 100, such as the metal temperature predictor 108 and the stress calculator 110 to calculate the predicted rotor stress, as will be disclosed below. Thus, the predicted process output $y^p(k)$ serves as an input to the other components of the example system 100. In some examples, rather than determining a setpoint, the disclosed MPC logic can output the predicted process output $y^p(k)$ in the form of a ramp setpoint bias, which can be applied to a fixed or predetermined ramp setpoint to adjust the ramp rate.

The predicted process input control input $u^p(k)$ is representative of the future action by the controller 106 in controlling the ramping of the turbine 102 by placing speed or load demands on the turbine 102. The predicted process input control input $u^p(k)$, or speed/load demand on the turbine 102 generates the predicted process output $y^p(k)$ or the predicted speed or load response. In some examples (e.g., steady state), the predicted process input control input $u^p(k)$ or speed/load demand is substantially the same as the predicted process output $y^p(k)$ or the predicted speed or load. In other examples, such as during dynamic transitions of the turbine 102 in response to the predicted process input control input $u^p(k)$, the predicted future output $y^p(k)$ lags behind the controller action $u^p(k)$. Also, in an ideal example, the actual control input signal u(k) (e.g., representative of the speed or load demand) is the same or substantially the same as the predicted control input signals $u^p(k)$ of each simulation step.

As part of advancement of the forward simulation phase, a comparison is performed between the simulation step and the MPC prediction horizon $H_p$ (block 210) to determine whether the simulation step is equal to the length of the prediction horizon $H_p$. As disclosed above, the simulation steps increment by one (e.g., move forward a sampling time period at each step). At some time during implementation the simulation model, the number of simulation steps will reach the last time period or length of the prediction horizon $H_p$ (e.g., following the illustrative example above, the fourth time period). If the incrementing simulation step is less than the length of the prediction horizon $H_p$, the simulation step is increased or advanced by another increment (e.g., another time period) such that the simulation step is defined to be the simulation step+1. The optimization of Equation 4 is performed using the increased simulation step (block 206). The predicted control input signal $u^p$ and the resulting predicted process output $y^p$ is saved in the prediction profile data queue, and the comparison of the simulation step (e.g., the increased simulation step) to the prediction horizon $H_p$ (block 208) is repeated until the simulation step reaches the length of the prediction horizon $H_p$ (e.g., following the illustrative example above, the prediction horizon $H_p$ corresponding to four time periods).

If the simulation step is equal to the MPC prediction horizon $H_p$, the example method 200 continues with setting the actual time increment (as compared to the simulated time) as k+1 (where k is a current time) and waiting for the actual time k+1 to arrive (block 214). The example method 200 includes repeating the identification of the state variables and the optimization based on the MPC logic at the current time k+1 and at a simulated sampling time (e.g., blocks 202-212).

Thus, the example method 200 predicts the process output $y^p(k)$ based on a forward simulation phase that simulates a future time period and predicts the process output $y^p(k)$ over the prediction horizon $H_p$. Using the predicted control input $u^p(k)$, the example method 200 implements a simulation model that predicts the process output $y^p(k)$ for simulated time steps that advance over the prediction horizon $H_p$ to build the load/speed profile. The predicted process output $y^p(k)$ is used by the other components of the example system 100 to evaluate the predicted setpoint in view of the allowable stress on the turbine 102.

In particular, the example system 100 of FIG. 1 provides for further evaluation of the predicted setpoint in view of the allowable stress that can be tolerated by the turbine 102 without, for example, damage to or a risk of damage to one or more components of the turbine 102. Based on the evaluation of the predicted setpoint, the control input commands sent to the turbine controller 105 by the controller 106 can be dynamically adjusted to provide for an optimized setpoint that also minimizes damage to the turbine 102 in view of allowable stress limits.

To evaluate the effect of the predicted setpoint or process output $y^p$, the example system 100 of FIG. 1 includes a metal temperature predictor 108. Surface temperature of the rotor 104 is affected by the steam temperature and the flow of steam admitted to the turbine 102. As disclosed above, the surface temperature of the rotor 104 of the turbine 102 can vary as the rotor 104 moves from a non-operating state to an operating state. For example, surface temperatures can range from 250° F. to 950° F. The metal temperature predictor 108 calculates a metal surface temperature profile of the rotor 104 based on empirical data and the predicted setpoint profile generated by the controller 106 as disclosed above in connection with the example method 200 of FIG. 2. The metal temperature predictor 108 predicts the surface temperature of the metal of the rotor 104 along the prediction horizon $H_p$ for which the process output setpoint is predicted by the controller 106. In particular, the metal temperature predictor 108 predicts the surface temperature of the metal of the rotor 104 for each setpoint predicted by the controller 106 over the prediction horizon $H_p$ to generate the metal surface temperature profile of the rotor 104.

The temperature of the steam and the flow of the steam impact the speed of the rotor 104 (e.g., the speed of rotation of the blades) before the breaker associated with the generator of the turbine 102 is closed. The temperature of the steam and the flow of the steam also impact the load after the breaker is closed. Thus, the rotor speed and the load can be used as input variables to the metal temperature predictor 108 for predicting the rotor surface temperature. In some examples, one or more additional input variables other than the speed and load are used by the metal temperature predictor 108 to predict the surface temperature of the rotor.

The metal temperature predictor 108 predicts the surface temperature using a liner model that is based on empirical data. An example linear transfer model employed by the metal temperature predictor 108 can be expressed as:

$$\frac{y(z)}{u(z)} = \frac{b_1 z^{-1} + \ldots + b_{n-1} z^{-n+1}}{1 + a_1 z^{-1} + a_2 z^{-2} + \ldots + a_n z^{-n}}, \quad \text{(Eq. 5)},$$

where y is an output variable, u is an input variable, n is an order of the system, z is a time shift operator, and parameters a and b are constants.

Equation 5 can be expressed in the time domain as:

$$y(k) = -a_1 y(k-1) - a_2 y(k-2) - \ldots - a_n y(k-n) + b_1 u(k-1) + \ldots + b_{n-1} u(k-n+1) \quad \text{(Eq. 6)},$$

where k represents a current time and u(k−1), u(k−2) . . . , u(k−n+1) are historical control input variables generated during the forward simulation phase of the example method 200 of FIG. 2 (e.g., blocks 206-212). Thus, the metal temperature predictor 108 calculates the predicted metal surface temperature profile y(k) by accounting for the history of the process input variables (e.g., u(k−1), u(k−2)) . . . , u(k−n+1)) generated as part of the forward simulation model (e.g., as disclosed in connection with the example method 200 of FIG. 2 (e.g., blocks 206-212)).

The parameters a, b, etc. for Equations 5 and 6 can be obtained from empirical data. In some examples, temperature data at different turbine loads is collected from turbine operating plants. For example, a signal (e.g., a step signal, a sinusoidal signal, etc.) can be injected into the turbine process at an input point. The process input data (e.g., speed or load) and the output data (e.g., metal temperature) can be recorded. The saved data can be used as the input data to a linear model identification program that generates a curve fitting with respect to the empirical data based on, for example, a least squares fit. Also, in some examples, a global optimization method is used to eliminate noise in the saved data as substantially described in U.S. Pat. No. 8,560,283, which is incorporated herein by reference. Alternatively, in some examples, the surface temperature can be predicted based on a nonlinear first principle model rather than an empirical data driven model.

The predicted metal surface temperature profile calculated by the metal temperature predictor 108 is provided to a stress calculator 110. The stress calculator 110 uses the predicted metal surface temperature profile to predict the stress on the rotor 104 for each predicted temperature in the profile over the prediction horizon $H_p$. Thus, the stress calculator 110 generates a stress profile. As the predicted metal surface temperature profile is based on the load/speed profile including the predicted process output $y^p(k)$, the stress calculator 110 accounts for the predicted setpoint generated by the controller 106 in the stress calculations. In some examples, the stress calculator 110 also calculates a current or real-time stress on the rotor 104 based on a current metal surface temperature of the rotor.

The stress calculator 110 determines or predicts the stress experienced by the rotor 104 (e.g., the stress at each temperature value in the predicted metal surface temperature profile) based on metal properties and thermal expansion characteristics of the material of the rotor 104. In some examples, the rotor surface stress is calculated for one or more sections of the rotor 104. As surface temperature of the rotor 104 increases while the turbine 102 transitions from the non-operating state to the operating state, this increased temperature is propagated throughout the rotor 104. The stress calculator 110 calculates the real-time stress at one more time intervals based on the current surface temperature for one or more sections of the rotor 104. The stress calculator 110 calculates the predicted stress based on the material properties (e.g., metal type) of the rotor 104 and the metal surface temperature profile for the prediction horizon $H_p$ generated by the metal temperature predictor 108.

The example system 100 also includes an allowable stress calculator 112, which uses empirical data to construct an allowable stress curve for the turbine 102. The empirical data can include cyclic expenditure curves that are associated with starting and loading the turbine 102. In particular, the cyclic expenditure curves relate a rate of change of steam temperature (e.g., degree/hour) with a change in the rotor surface metal temperature. Using the empirical data, the allowable stress calculator 112 constructs an allowable stress curve for the turbine 102 from the cyclic expenditure curves.

To evaluate the stress on the rotor 114 in view of the predicted setpoint and/or the actual stress conditions relative to the allowable stress, the example system 100 includes a comparer 114. The comparer 114 compares the predicted stress values and the actual stress in the stress profile generated by the stress calculator 110 with the allowable stress curve constructed by the allowable stress calculator 112. The comparer 114 determines whether any of the predicted stress values and/or the actual stress exceeds the allowable stress based on the allowable stress curve. In some examples, the comparer 114 compares the predicted stress and the allowable stress for a time in the future. In other examples, the comparer 114 compares the predicted stress with the allowable stress over a time period corresponding to the prediction horizon $H_p$. For example, if the metal surface temperature profile includes ten predicted temperature values, the stress calculator 110 will calculate ten predicted stress values and the comparer 114 will determine if any of the ten predicted stress values or the actual stress exceeds the allowable stress.

The comparison of the predicted stress and/or the real-time stress with the allowable stress provides a relative stress value, or surface stress ratio (e.g., rotor surface stress over allowable stress). For example, if the surface stress ratio exceeds a value of 1 or approaches a value of 1 within a predefined threshold amount, the comparer 114 determines that allowable stress is violated. If the comparer 114 determines that either the predicted stress or the real-time stress is greater than the allowable stress, the comparer 114 flags the allowable stress as being violated. Thus, in the example system 100, the allowable stress curve generated by the allowable stress calculator 112 serves as a constraint with respect to the setpoint predicted by the controller 106 and the corresponding control input signals provided to the turbine 102.

In some examples, if the predicted stress (e.g., one or more predicted stress values in the stress profile) and/or the real-time stress is less than the allowable stress, the comparer 114 determines an amount by which the predicted stress and/or the real-time stress is less than the allowable stress (e.g., if the predicted stress and/or the real-time stress is a certain percentage or an amount below the allowable stress). The comparer 114 determines if the difference between the allowable stress and the predicted stress and/or the real-time stress falls within a threshold range relative to the allowable stress. If the comparer 114 determines that the predicted stress and/or the real-time stress is nearing the allowable stress, the comparer 114 can flag the predicted stress and/or the real-time stress as approaching a value that may result in a violation of the allowable stress.

The result of the comparison between the predicted stress and/or the real-time stress and the allowable stress as determined by the comparer 114 is provided to a decision support tuner 116 of the example system 100. If the predicted stress and/or the real-time stress violate the allowable stress, the decision support tuner 116 sends a command to the controller 106. In some examples, in response to the feedback from the decision support tuner 116, the controller 106 sends a command to the turbine controller 105 to stop or reduce ramping of the turbine 102 in view of the violation of the allowable stress. In such examples, the controller 106 can wait to receive another user input such as a speed setpoint before determining a different setpoint for the turbine 102. In other examples, the controller 104 automatically determines a different setpoint for the turbine 102 in view of the stress violation.

The decision support tuner 116 also uses the result of the comparison between the allowable stress and the predicted stress to dynamically tune the MPC logic and associated functions and parameters (e.g., the process output constraints) used by the controller 106 in predicting the setpoint. Based on the result of the comparison performed by the comparer 114 with respect to the predicted stress and the allowable stress, the decision support tuner 116 adjusts, updates, and/or revises the MPC logic used by the controller 106 to predict the setpoint, thereby affecting the speed or load demands sent to the turbine 102 and the resulting turbine response (e.g., via the turbine controller 105). In particular, the decision support tuner 116 adjusts an aggressiveness of the logic used by the controller 106 in optimizing the setpoint.

For example, if the comparer 114 determines that the predicted stress violates the allowable stress, the decision support tuner 116 reduces an aggressiveness of the logic used by the controller 106 such that the controller 106 sends a speed or load demand to the turbine 102 that results in a reduced rate of ramping the turbine 102 as compared to the ramping rate associated with the setpoint that resulted in the stress violation. If the decision support tuner 116 determines that the predicted stress does not violate the allowable stress within a threshold range (e.g., the predicted stress is a certain percentage or amount below the allowable stress), the decision support tuner 116 also can adjust the functions and parameters used by the controller 106. For example, the adjustments by the decision support tuner 116 can cause the controller 106 to send a control input signal that results in the turbine ramping to the fully operational state at a faster ramp rate than the turbine 102 would have based on an initially predicted setpoint.

The decision support tuner 116 uses fuzzy logic to dynamically tune the MPC logic employed by the controller 106 and, as a result, to adjust the response quickness of the turbine 102 in reaching a speed or a load in view of the control inputs sent by the controller 106. As disclosed above, the optimization executed using Equations 3 and 4 includes a weighting factor or tuning parameter R that affects an aggressiveness of the speed setpoint or the load setpoint of the turbine 102 as determined by the controller 106. For example, if the tuning parameter R has a small value relative to the tuning parameter Q, the load ramp or the speed ramp rate will be more aggressive. Thus, the tuning parameter R can be modified by the decision support tuner 116 based on the feedback from the comparer 114 to adjust the setpoint and, thus, the response of the turbine 102.

For example, the predicted allowable stress violation e(t) can be expressed as e(t)=actual stress−maximum allowable stress. A change in the predicted stress violation e(t) can be expressed as $\Delta e(t)/\Delta t$. Also, a change in the tuning parameter of the controller 106 can be expressed as $\Delta w(t)$. The example method 300 can apply one or more rule sets based on known fuzzy logic principles to adjust the weighting parameter R in view of the allowable stress violation.

An example fuzzy logic system includes a Sugeno type of fuzzy logic system, where triangle/trapezoid, Gaussian, or bell shapes are used as membership functions of the inputs and singleton output values are used as membership functions of the output. Example rules that can be applied can be expressed as disclosed below in Table 1, according to the following nomenclature: NL: negative large; NS: negative small; ZE: zero; PS: positive small; and PL: positive large.

TABLE 1

Fuzzy Influence System Rule Table

| | | e(t) | | | | |
|---|---|---|---|---|---|---|
| Δw = f(e, Δe) | | NL | NS | ZE | PS | PL |
| Δe(t) | NL | NL | NL | NS | NS | ZE |
| | NS | NL | NS | NS | ZE | PS |
| | ZE | NS | NS | ZE | PS | PS |
| | PS | NS | ZE | PS | PS | PL |
| | PL | ZE | PS | PS | PL | PL |

As an example implementation of the rules of Table 1, if the predicted allowable stress violation e(t) is NS (negative small) and the predicted change in the allowable stress violation Δe(t) is PL, the change in the controller tuning parameter Δw(t) is PS (positive small). A final output or tuning change implemented by the controller 106 in connection with the MPC logic is calculated as an aggregate of the outputs of all the active rules as part of a de-fuzzification process. Examples of known de-fuzzification methods that can be used to produce a quantifiable result from the fuzzy logic include Center of Gravity (COG) and Middle of Maximum (MOM).

For example, if the predicted allowable stress violation e(t) is 800 psi and the predicted stress violation change Δe(t) is 350 psi/min, fuzzy logic singleton values can be selected as:

NL: −5, NS: −1, ZE: 0, PS: 1, PL: 5.

Also, continuing with the above-disclosed example, the following rules can be applied:

Rule (1): If e(t) is PL and Δe(t)/Δt is PL, then the tuning change Δw(t) is PL; and Rule (2): If e(t) is PS and Δe(t)/Δt is PL, then the tuning change Δw(t) is PL.

Rules (1) and (2) can be translated into the following example numeric logics:

Rule (1): If e(t) is 0.7 and Δe(t)/Δt is 0.6, then the tuning change Δw(t) is 5; and Rule (2): If e(t) is 0.4 and Δe(t)/Δt is 0.6, then the tuning change Δw(t) is 5.

Rules (1) and (2) can be further reduced to:

Rule (1): If Δe(t)/Δt is 0.6, then the tuning change Δw(t) is 5; and

Rule (2): If e(t)/Δt is 0.4, then the tuning change Δw(t) is 5.

After de-fuzzification using one or more known methods, the final output for the above-disclosed example can be obtained as follows: (0.6*5+0.4*5)/(0.6+0.4)=5. Based on the final output of the above-disclosed example, the weighting parameter R is increased by 5, which reduces (e.g., slows down) the load or speed setpoint movement of the turbine 102.

Figure 3:
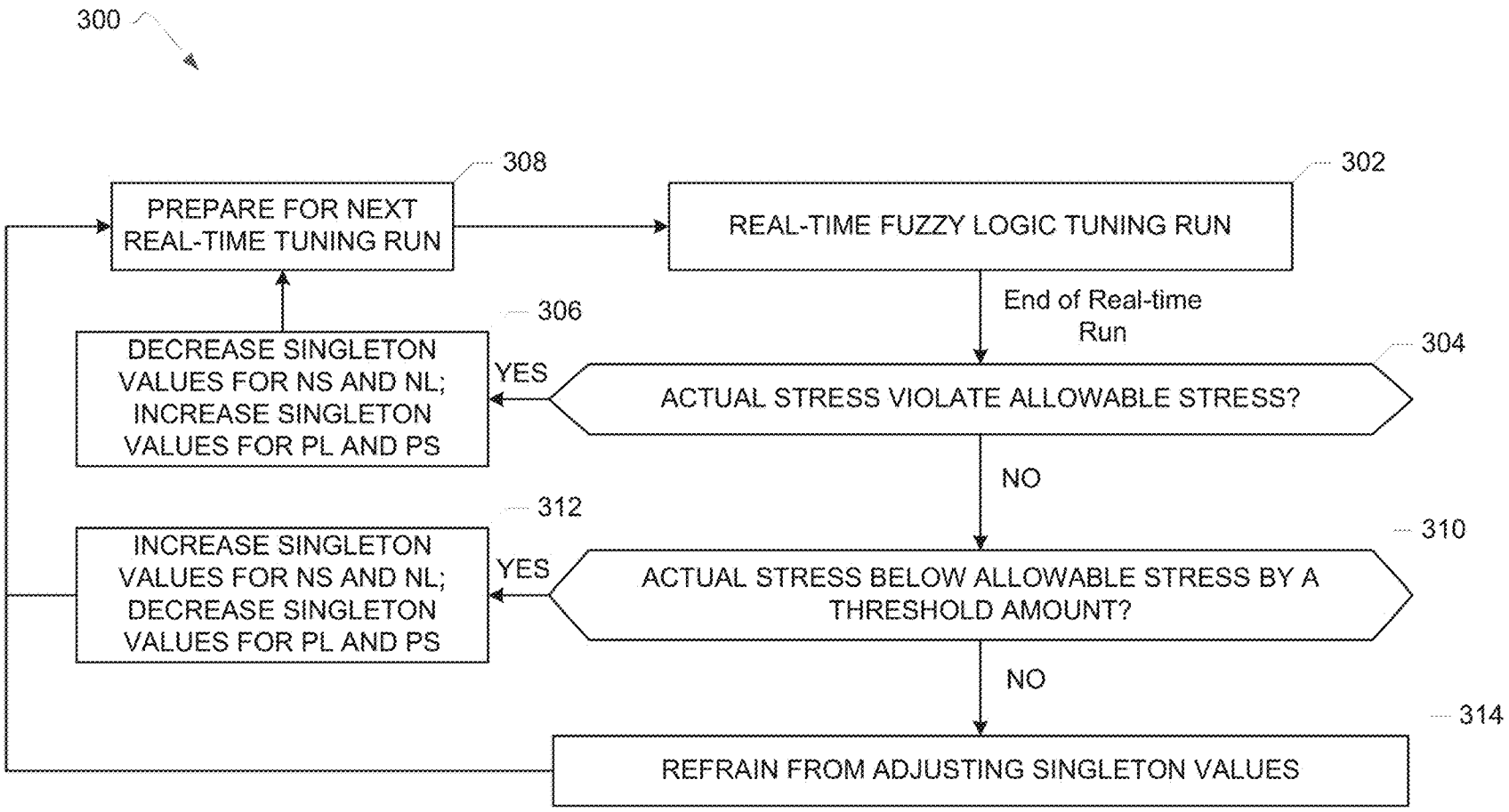
FIG. 3 is a flow diagram of an example method that may be performed to dynamically tune the controller of the example control system of FIG. 1

In some examples, the weighting parameter R can be tuned or adjusted in real time. However, such real-time tuning can strain the example system 100 in implementing the MPC logic, calculating the predicted rotor stress, and providing real-time feedback to the controller 106. To reduce the real-time tuning efforts by the decision support tuner 116, an offline, automatic adaptive tuning method can be implemented by the decision support tuner 116. FIG. 3 is an example method 300 for offline tuning of the MPC logic employed by the controller 106. The example method 300 can be implemented by the decision support tuner 116. In the example method 300, the fuzzy logic inference rules (e.g., Table 1) and membership functions are not adjusted; rather, only the singleton output values are adjusted if such an adjustment is determined to be necessary based on the actual stress as compared to the allowable stress. Further, the adjustment to the singleton values only happens between real-time runs of the decision support tuner 116 in implementing the fuzzy logic tuning.

The example method 300 begins with tuning of a controller (e.g., the model predictive controller 106) based on fuzzy logic in real-time (block 302). At the end of the real-time tuning (e.g., by the decision support tuner 116), the example method 300 includes determining whether the actual stress violated the allowable stress (e.g., as determined by the comparer 114) (block 304). If the allowable stress violated the actual stress, the example method 300 automatically decreases the fuzzy logic singleton values for NS (negative small) and NL (negative large) and increases the singleton values for PL (positive large) and PS (positive small) (block 306). In the example method 300, the adjustment to the singleton values due to the actual stress violating the allowable stress occurs before the next real-time implementation or run of the fuzzy logic tuning (block 308). The adjusted singleton values are used in the next real-time fuzzy logic run or implementation of the fuzzy logic to tune the controller (block 302).

If the actual stress does not violate the allowable stress, the example method 300 includes determining whether the actual stress is below the allowable stress by a predetermined threshold amount (block 310). In some examples, the threshold amount is representative of an amount by which the actual stress is considered to be below the allowable stress limit (e.g., the actual stress is significantly below the allowable stress limit). Thus, in such examples, the load or speed setpoint can be increased without a risk of violating the allowable stress. To tune or adjust the MPC logic used by the controller (e.g., the controller 106) such that a more aggressive load or speed setpoint is output, the example method 300 includes increasing singleton values for NS (negative small) and NL (negative large) and decreasing singleton values for PL (positive large) and PS (positive small) (block 312). In such examples, the adjustment to the singleton values based on the actual stress being below the allowable stress by a threshold amount occurs before the next real-time run of the fuzzy logic tuning (block 308) such that the adjusted singleton values are used in the next real-time fuzzy logic run to tune the controller (block 302).

If the actual stress is not below the allowable stress by the threshold amount, the example method 300 refrains from adjusting the singleton values (block 314). In such examples, although the actual stress does not violate the allowable stress, the actual stress is not below the allowable stress limit by an amount (e.g., the threshold amount) that would warrant an increase in the aggressiveness of the MPC logic in calculating the speed/load setpoint. Therefore, the example method 300 does not adjust the singleton values so as not to risk a violation of the actual stress in view of the allowable stress by adjusting the aggressiveness of the controller. Refraining from adjusting the singleton values also prevents the controller from taking a less aggressive approach that unnecessarily slows down the speed or load setpoint. In such examples, the singleton values are not changed between the real-time fuzzy logic tuning runs (blocks 302, 308).

Thus, the example method 300 provides for an efficient, offline means of providing for an evaluation of the actual stress in view of the allowable stress with respect to the dynamic tuning of the controller. Based on the comparison of the actual stress to the allowable stress, the example method 300 determines whether the singleton values should be revised or adjusted as part of the next implementation of the real-time fuzzy logic tuning of the MPC logic. Thus, between consecutive implementations of the real-time fuzzy logic tuning, the example method 300 provides for adjustments that can be implemented in future real-time tuning of the controller.

The example system 100 also includes a model adaptor 118. The model adaptor 118 collects the data generated by one or more of the controller 106 (e.g., the predicted setpoint), the metal temperature predictor 108 (e.g., the predicted metal temperature), the stress calculator 110 and the allowable stress calculator 112 (e.g., the actual stress, the predicted stress, and the allowable stress), the comparer 114 (e.g., allowable stress violations and/or thresholds), and the decision support tuner 116 (e.g., the adjustments to the weighting parameters). The model adaptor 118 can receive the data from the one or more other components of the example system 100 in substantially real-time, such as when the controller 106 determines a predicted setpoint and/or the comparer 114 determines if there is a stress violation. In other examples, the model adaptor 118 receives the data from the one or more other components after, for example, the decision support tuner 116 determines whether the MPC logic (e.g., one or more tuning parameters such as the tuning parameter R) used by the controller 106 should be adjusted.

Based on the data received from the one or more other components of the example system 100, the model adaptor 118 calibrates and/or re-calibrates the models used by the MPC controller 106 and/or the metal temperature predictor 108 In some examples, the data collected by the model adaptor 118 is used as a baseline or known values for calibrating the models or algorithms used by the one or more components of the example system 100 in determining and evaluating the predicted setpoint.

For example, the prediction model used by the controller 106 predicts the setpoint (e.g., a speed setpoint or a load setpoint) in view of the target setpoint and actual or real-time ramp speeds or loads. A difference between the predicted setpoint and the actual speed or load ramp values represents a prediction error of the prediction model used by the controller 106. If the prediction error is above a predetermined threshold (which can be indicative of a larger prediction error), the model adaptor 118 adapts or adjusts the prediction model based on, for example empirical data. As another example, if a difference between a predicted metal surface temperature calculated by the metal temperature predictor 108 and an actual surface temperature results in a prediction error above a threshold, then the model adaptor 118 revises the model used by the metal temperature calculator 108 to predict the temperature.

While an example manner of implementing the example system 100 is illustrated in FIG. 1, one or more of the elements, processes and/or devices illustrated in FIG. 1 may be combined, divided, re-arranged, omitted, eliminated and/or implemented in any other way. Further, the example model predictive controller 106, the example metal temperature predictor 108, the example stress calculator 110, the example allowable stress calculator 112, the example comparer 114, the example decision support tuner 116, the example model adaptor 118 and/or, more generally, the example system 100 of FIG. 1 may be implemented by hardware, software, firmware and/or any combination of hardware, software and/or firmware. Thus, for example, any of the example model predictive controller 106, the example metal temperature predictor 108, the example stress calculator 110, the example allowable stress calculator 112, the example comparer 114, the example decision support tuner 116, the example model adaptor 118 and/or, more generally, the example system 100 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example model predictive controller 106, the example metal temperature predictor 108, the example stress calculator 110, the example allowable stress calculator 112, the example comparer 114, the example decision support tuner 116, the example model adaptor 118 is/are hereby expressly defined to include a tangible computer readable storage device or storage disk such as a memory, a digital versatile disk (DVD), a compact disk (CD), a Blu-ray disk, etc. storing the software and/or firmware. Further still, the example system 100 of FIG. 1 may include one or more elements, processes and/or devices in addition to, or instead of, those illustrated in FIG. 1, and/or may include more than one of any or all of the illustrated elements, processes and devices.

Figure 4:
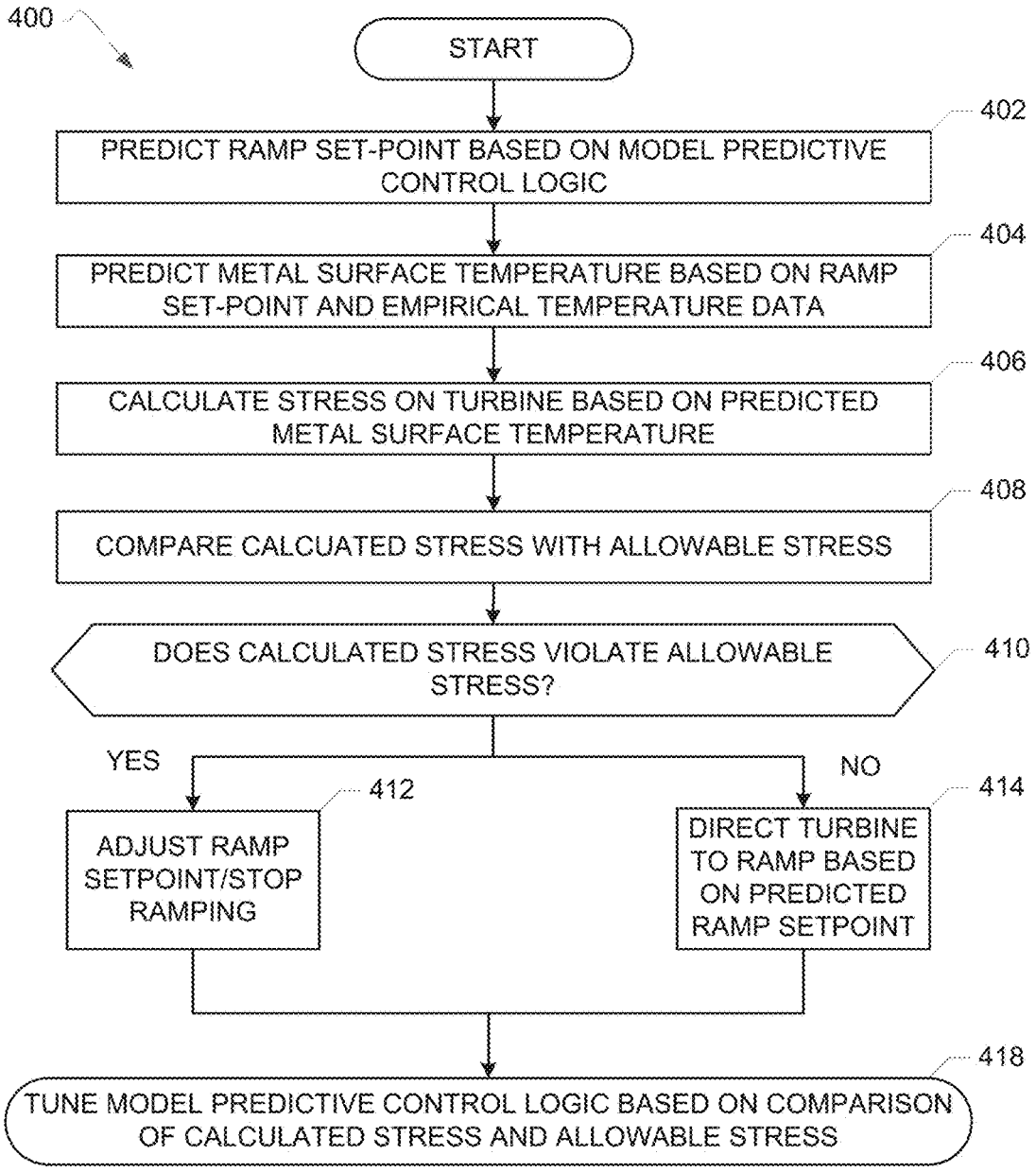
FIG. 4 is a flow diagram of an example method that may be executed to implement the example control system of FIG. 1.

FIG. 4 illustrates a flowchart representative an example method 400 that can be implemented to predict a setpoint (e.g., a speed setpoint or a load setpoint) for a turbine (e.g., the turbine 102 of FIG. 1) and to tune the aggressiveness of the MPC logic implemented by a controller (e.g., the controller 106) in predicting the setpoint. The example method 400 begins with predicting a setpoint (block 402). In the example method 400, predicting the setpoint can be performed by a controller (e.g., the controller 106 of FIG. 1) using one or more model predictive control techniques to predict the setpoint over a forward simulation phase as substantially described in connection with the example method 200 of FIG. 2. In some examples, predicting the setpoint is based on one more inputs, such as a target setpoint for transitioning the turbine from a non-operating state to an operating state.

The example method 400 includes predicting a metal surface temperature of one or more components of the turbine, such as a rotor of the turbine (e.g., the rotor 104 of FIG. 1) (block 404). In some examples, predicting the metal surface temperature is performed by a calculator (e.g., the metal temperature predictor 108). In the example method 400, predicting the metal surface temperature is based on the predicted setpoint and empirical turbine temperature data. The empirical or known temperature data can provide parameters of a linear model that is used to predict the metal surface temperature for the predicted setpoint.

The example method 400 includes calculating a stress on the turbine based on the predicted metal surface temperature (block 406). Calculating the stress can include predicting a stress based on the predicted metal surface temperature and one or more material properties of the turbine, such as a type of metal from which the rotor is constructed. In some examples, calculating the stress includes calculating an actual stress on the rotor in real-time based on a current surface temperature of the rotor. The stress calculations of the example method 400 can be performed by one or more calculators (e.g., the stress calculator 110 of FIG. 1).

In the example method 400, the calculated stress (e.g., the predicted stress and/or the actual stress) is compared (e.g., via the comparer 114 of FIG. 1) to an allowable stress for the turbine (block 408). The allowable stress can be determined or calculated from one or more empirical data curves that map a rate of change of a temperature of the steam provided to the turbine with a change in surface metal temperature of the rotor (e.g., via the allowable stress calculator 112). Based on the comparison, the example method 400 includes determining whether the calculated stress violates the allowable stress (block 410). In some examples, the calculated stress is determined to violate the allowable stress if the calculated stress exceeds the allowable stress or exceeds a threshold range with respect to the allowable stress.

If the calculated stress violates the allowable stress, the example method 400 includes adjusting the setpoint and/or stopping the ramping (block 412). For example, the controller (e.g., the controller 106) can revise or re-calculate the predicted setpoint to slow down the ramp rate of the turbine and, thus, reduce the stress on the rotor. The revised setpoint can be provided to the turbine (e.g., via instructions from the controller 106). In examples where the ramping is in progress, the ramping of the turbine may be automatically stopped or reduced based on the determination that the predicted setpoint violates the allowable stress (e.g., via instructions from the controller 106).

If the predicted stress does not violate the allowable stress, the example method 400 includes directing the turbine to ramp based on the predicted setpoint (block 414). Directing the turbine to ramp based on the predicted setpoint can be implemented via one or more commands by the controller (e.g., the controller 106) sent to the turbine (e.g., the turbine controller 105 of the turbine 102).

In the example method 400, the comparison of the calculated stress with the allowable stress also serves as feedback for tuning the MPC logic used to predict the setpoint. In particular, the example method 400 includes tuning the MPC logic based on the comparison of the calculated stress and the allowable stress (block 418). For example, if the calculated stress violates the allowable stress, one or more parameters and/or constraints of the MPC logic (e.g., the tuning parameter R) can be adjusted (e.g., via the decision support tuner 116 of FIG. 1) to reduce the aggressiveness of the MPC logic such that turbine ramps at a reduced ramp rate as compared to the ramping rate at the initial predicted setpoint (e.g., the setpoint determined at block 402). In examples where the calculated stress does not violate the allowable stress, tuning the MPC logic can include maintaining one or more of the parameters and/or constraints of the MPC logic. Alternatively, tuning the MPC logic can include adjusting the one or more parameters and/or constraints to increase an aggressiveness of the MPC logic such that the turbine ramps at a faster rate as compared to the initial predicted setpoint (e.g., the setpoint determined at block 402). In some examples, tuning the one or more parameters of the MPC logic is based on fuzzy logic as substantially disclosed in connection with the example method 300 of FIG. 3.

Thus, the example method 400 provides for predicting a setpoint for transitioning a turbine from a non-operating state to an operating state without violating an allowable stress limit that can be tolerated by the turbine. In particular, the example method 400 includes for an evaluation of the predicted setpoint based on a comparison of the predicted stress and/or the actual stress on the turbine resulting from the predicted setpoint with the allowable stress. If the predicted or actual stress violates the allowable stress, the example method 400 responds by dynamically adjusting and/or stopping ramping of the turbine to not place undue stress on the turbine, which can lead to damage to the turbine components. Further, based on the comparison, the example method 400 automatically tunes the logic or algorithms used to predict the setpoint, thereby providing a feedback-driven method for determining the setpoint.

The flowcharts of FIGS. 2-4 are representative of example methods that may be used to implement the example system 100 of FIG. 1. In these examples, the methods may be implemented using machine readable instructions that comprise a program for execution by a processor such as the processor 512 shown in the example processor platform 500 discussed below in connection with FIG. 5. The program may be embodied in software stored on a tangible computer readable storage medium such as a CD-ROM, a floppy disk, a hard drive, a digital versatile disk (DVD), a Blu-ray disk, or a memory associated with the processor 512, but the entire program and/or parts thereof could alternatively be executed by a device other than the processor 512 and/or embodied in firmware or dedicated hardware. Further, although the example program is described with reference to the flowcharts illustrated in FIG. 2-4, many other methods of implementing the example system 100 may alternatively be used. For example, the order of execution of the blocks may be changed, and/or some of the blocks described may be changed, eliminated, or combined.

As mentioned above, the example methods of FIGS. 2-4 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example methods of FIGS. 2-4 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

Figure 5:
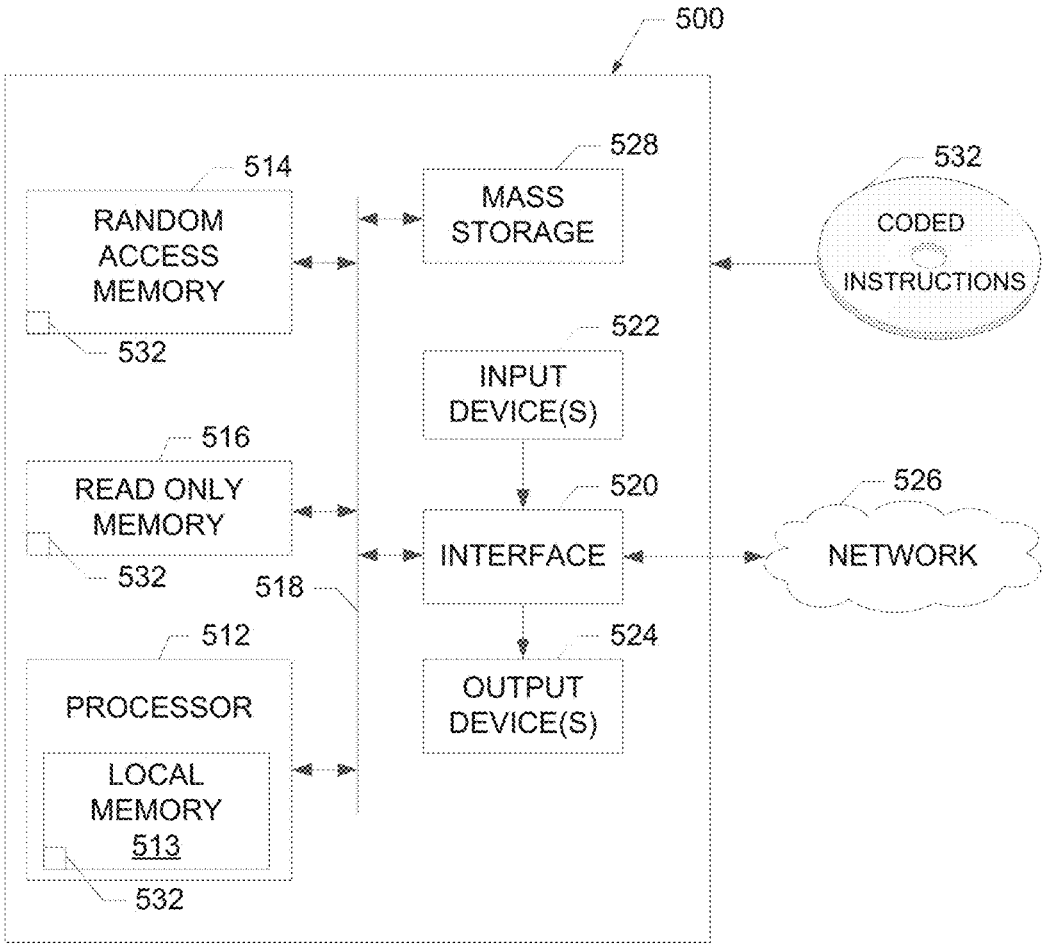
FIG. 5 is a diagram of an example processor platform that may be used to carry out the example methods of FIGS. 2-4 and/or, more generally, to implement the example control system of FIG. 1.

FIG. 5 is a block diagram of an example processor platform 500 capable of executing the instructions of FIGS. 2-4 to implement the example system 100 of FIG. 1. The processor platform 500 can be, for example, a server, a personal computer, a mobile device (e.g., a cell phone, a smart phone, a tablet such as an iPad™), a personal digital assistant (PDA), an Internet appliance, or any other type of computing device.

The processor platform 500 of the illustrated example includes a processor 512. The processor 512 of the illustrated example is hardware. For example, the processor 512 can be implemented by one or more integrated circuits, logic circuits, microprocessors or controllers from any desired family or manufacturer.

The processor 512 of the illustrated example includes a local memory 513 (e.g., a cache). The processor 512 of the illustrated example is in communication with a main memory including a volatile memory 514 and a non-volatile memory 516 via a bus 518. The volatile memory 514 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 516 may be implemented by flash memory and/or any other desired type of memory device. Access to the main memory 514, 516 is controlled by a memory controller.

The processor platform 500 of the illustrated example also includes an interface circuit 520. The interface circuit 520 may be implemented by any type of interface standard, such as an Ethernet interface, a universal serial bus (USB), and/or a PCI express interface.

In the illustrated example, one or more input devices 522 are connected to the interface circuit 520. The input device(s) 522 permit(s) a user to enter data and commands into the processor 512. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 524 are also connected to the interface circuit 520 of the illustrated example. The output devices 524 can be implemented, for example, by display devices (e.g., a light emitting diode (LED), an organic light emitting diode (OLED), a liquid crystal display, a cathode ray tube display (CRT), a touchscreen, a tactile output device, a printer and/or speakers). The interface circuit 520 of the illustrated example, thus, typically includes a graphics driver card, a graphics driver chip or a graphics driver processor.

The interface circuit 520 of the illustrated example also includes a communication device such as a transmitter, a receiver, a transceiver, a modem and/or network interface card to facilitate exchange of data with external machines (e.g., computing devices of any kind) via a network 526 (e.g., an Ethernet connection, a digital subscriber line (DSL), a telephone line, coaxial cable, a cellular telephone system, etc.).

The processor platform 500 of the illustrated example also includes one or more mass storage devices 528 for storing software and/or data. Examples of such mass storage devices 528 include floppy disk drives, hard drive disks, compact disk drives, Blu-ray disk drives, RAID systems, and digital versatile disk (DVD) drives.

Coded instructions 532 to implement the methods of FIGS. 2-4 may be stored in the mass storage device 528, in the volatile memory 514, in the non-volatile memory 516, and/or on a removable tangible computer readable storage medium such as a CD or DVD.

From the foregoing, it will be appreciated that the above-disclosed apparatus and methods determine a speed setpoint and/or a load setpoint for transitioning a steam turbine from a non-operating state to an operating state without violating a predetermined allowable stress limit of the turbine. The disclosed examples use MPC logic in connection with a forward simulation model to predict a setpoint over a prediction horizon. The forward simulation model provides for improved prediction of the turbine ramp rate over known MPC logic, which is limited with respect to prediction abilities. Further, the disclosed examples provide for control inputs to the turbine corresponding to speed or load demands on the turbine that generate the predicted setpoint.

The disclosed examples evaluate the predicted setpoint in view of the allowable stress on the turbine to reduce the risk of damage to the turbine from thermal stress during the transition of the turbine to a fully operational state. In the disclosed examples, the predicted setpoint is used to predict a metal surface temperature of a rotor of the turbine. Based on the predicted surface temperature, the disclosed examples predict a stress on the turbine and compare the predicted stress to the allowable stress. If the predicted stress violates the allowable stress, the disclosed examples automatically respond by adjusting the setpoint and/or instructing the turbine to stop ramping to prevent damage to the turbine in view of the allowable stress violation. Further, the disclosed examples dynamically adjust one or more parameters, functions, and/or constraints of the MPC logic in response to the comparison between the predicted and allowable stresses. In addition, such adjustments can be determined offline between iterative runs of the MPC logic and simulation model to increase the efficiency of the tuning of the MPC logic without overloading the disclosed control systems in real-time. Thus, the disclosed examples provide for predictive modeling of the turbine response in view of speed or load demands placed on the turbine in implementing the setpoint. Further, the disclosed examples evaluate the response of the turbine in view of, for example, a predicted metal surface temperature of the turbine rotor. Such an evaluation provides for a determination of whether the setpoint will cause undue stress on the rotor and can be used to provide feedback to the disclosed control systems for future predictions of the turbine ramp rate. By determining an optimal setpoint that can approach but not exceed an allowable stress limit, the disclosed examples provide for efficient start-up of the turbine with a reduced or substantially eliminated risk of damage to the turbine.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A method comprising:

determining, by executing an instruction with a processor, a setpoint for a turbine rotor by performing an optimization to minimize a difference between a predicted setpoint and a target setpoint for the turbine rotor;

evaluating the setpoint over a prediction horizon relative to an allowable thermal stress threshold for the turbine rotor by:

predicting, by executing an instruction with the processor, a surface temperature profile of the turbine rotor for the prediction horizon based on the setpoint;

predicting, by executing an instruction with the processor, a first stress profile for the turbine rotor based on the surface temperature profile;

performing, by executing an instruction with the processor, a comparison of the first stress profile to a second stress profile; and adjusting, by executing an instruction with the processor, the setpoint if the comparison does not satisfy the allowable thermal stress threshold to generate an adjusted setpoint; and transmitting, by executing an instruction with the processor, a demand input signal based on the setpoint or the adjusted setpoint to the turbine rotor to cause the turbine rotor to transition from a first operating state to a second operating state.

2. The method of claim 1, wherein the first stress profile comprises a plurality of first stress values and the second stress profile comprises a plurality of second stress values and wherein if one of the first stress values is greater than one of the second stress values, the adjusting of the setpoint comprises reducing at least one of a speed ramp rate or a load ramp rate of the turbine.

3. The method of claim 2, wherein if one of the first stress values is within a threshold amount of one of the second stress values but less than the one of the second stress values, further comprising maintaining the setpoint.

4. The method of claim 1, wherein adjusting the setpoint comprises modifying one or more parameters of a prediction model used to predict the setpoint.

5. The method of claim 1, wherein predicting the first stress profile is further based on a metal type of the turbine rotor.

6. The method of claim 5, further comprising determining the second stress profile based on empirical stress data for the turbine rotor.

7. The method of claim 1, wherein determining the setpoint further comprises:

performing an optimization of a predictive model used to determine the predicted setpoint for a first sampling time period of the prediction horizon;

calculating a first simulated setpoint for a second sampling time period, the second sampling time period being a simulated time period occurring after the first sampling time period; and storing the first simulated setpoint in a database.

8. The method of claim 7, wherein predicting the surface temperature is based on the first simulated setpoint stored in the database.

9. The method of claim 8, further comprising:

calculating a second simulated setpoint for a third sampling time period based on a control input generated during the second simulated time period, the third sampling time period being a simulated time period occurring after the second simulated sampling time period; and storing the second simulated setpoint in the database.

10. The method of claim 1, wherein the setpoint is one of a speed setpoint or a load setpoint.

11. A system comprising:

a controller to:

perform an optimization to minimize a difference between a predicted setpoint and a target setpoint for a turbine; and determine a first setpoint of the turbine based on the optimization and a controller tuning parameter to ramp the turbine from a first operating state to a second operating state at a first rate;

a temperature predictor to predict a surface temperature of one or more components of the turbine based on the first setpoint and known temperature data;

a first stress calculator to determine a first stress on the turbine based on the predicted surface temperature;

a comparer to compare the first stress to a second stress; and an adjuster to adjust the controller tuning parameter based on the comparison, wherein if the first stress exceeds the second stress, the controller is to predict a second setpoint based on the optimization and the adjusted controller tuning parameter to ramp the turbine from the first operating state to the second operating state at a second rate, the second rate being a reduced rate relative to the first rate.

12. The system of claim 11, further comprising a second stress calculator to determine the second stress based on an allowable stress limit for the turbine.

13. The system of claim 11, further comprising a prediction profile database to store the first setpoint, wherein the temperature predictor is to retrieve the first setpoint from the database to predict the surface temperature.

14. The system of claim 11, wherein the comparer is to determine if the first stress is within a threshold range of the second stress, wherein if the first stress is within the threshold range, the adjuster is to refrain from adjusting the controller tuning parameter.

15. The system of claim 11, wherein the adjuster is to adjust the controller tuning parameter during a time period between the prediction of the first setpoint and the prediction of the second setpoint by the controller.

16. The system of claim 11, wherein the controller is to predict a speed response or a load response of the turbine based on the first setpoint as the turbine ramps from the first operating state to the second operating state.

17. The system of claim 11, wherein the first operating state is a non-operating state of the turbine and the second operating state is an operating state of the turbine.

18. A method for transitioning a turbine from a non-operating state to an operating state, the method comprising:

determining, by executing an instruction with a processor, a setpoint at which the turbine is to transition from the non-operating state to the operating state by performing an optimization to minimize a difference between a first predicted setpoint and a target setpoint for the turbine;

calculating, by executing an instruction with the processor, a surface temperature of a rotor of the turbine based on the setpoint and empirical temperature data;

calculating, by executing an instruction with the processor, a first stress on the rotor based on the surface temperature; and comparing, by executing an instruction with the processor, the first stress to an allowable stress limit for the turbine;

if the first stress exceeds the allowable stress limit, transmitting, by executing an instruction with the processor, a first input signal to the turbine to at least one of stop a ramping of the turbine from the non-operating state to the operating state or reduce a ramp rate of the turbine; and if the first stress is below the allowable stress limit by a threshold amount, transmitting, by executing an instruction with the processor, a second input signal to the turbine to increase a ramp rate of the turbine.

19. The method of claim 18, wherein determining the setpoint further comprises predicting the setpoint over one or more simulated time periods based on a prediction model.

20. The method of claim 19, further comprising adjusting the prediction model based on the comparison of the first stress to the allowable stress limit.

* * * * *